US008104620B2

(12) United States Patent
Lin et al.

(10) Patent No.: US 8,104,620 B2
(45) Date of Patent: Jan. 31, 2012

(54) MAGNETIC SWEEPER

(75) Inventors: Pei-Ying Lin, Taichung Hsien (TW); Chanwa Nguy, Cornelius, NC (US)

(73) Assignee: Steelworks Hardware, LLC, Northbrook, IL (US)

( * ) Notice: Subject to any disclaimer, the term of this patent is extended or adjusted under 35 U.S.C. 154(b) by 502 days.

(21) Appl. No.: 11/536,300

(22) Filed: Sep. 28, 2006

(65) Prior Publication Data

US 2008/0078698 A1 Apr. 3, 2008

(51) Int. Cl.
*B03C 1/00* (2006.01)

(52) U.S. Cl. ..... 209/215; 15/1

(58) Field of Classification Search ..... 209/213–232
See application file for complete search history.

(56) References Cited

U.S. PATENT DOCUMENTS

| | | | | | |
|---|---|---|---|---|---|
| 1,630,987 | A | * | 5/1927 | Turner | 209/215 |
| 2,654,480 | A | * | 10/1953 | Stem | 209/215 |
| 2,693,279 | A | * | 11/1954 | Box et al. | 209/215 |
| 2,716,254 | A | * | 8/1955 | Hoffmann et al. | 15/402 |
| 4,407,038 | A | | 10/1983 | Haase | |
| 4,904,376 | A | | 2/1990 | Haase | |
| 5,285,904 | A | | 2/1994 | Haase | |
| 5,395,148 | A | * | 3/1995 | Jameson et al. | 294/65.5 |
| 5,413,225 | A | * | 5/1995 | Shields | 209/614 |
| 5,549,207 | A | | 8/1996 | Busico | |
| 5,868,258 | A | | 2/1999 | Hubbard | |
| 5,979,957 | A | | 11/1999 | Conrad | |
| 6,113,169 | A | | 9/2000 | Gohman | |
| 6,142,310 | A | | 11/2000 | Haase et al. | |
| 6,158,792 | A | * | 12/2000 | Snider | 294/65.5 |
| 6,402,212 | B1 | | 6/2002 | Hsiao | |
| 6,669,024 | B2 | | 12/2003 | Ottens | |
| 6,677,846 | B2 | * | 1/2004 | Snider | 335/302 |
| 7,182,205 | B2 | * | 2/2007 | Pestone | 209/215 |
| 2004/0250375 | A1 | * | 12/2004 | Chen | 15/362 |
| 2005/0210627 | A1 | * | 9/2005 | Luebbering et al. | 15/410 |

FOREIGN PATENT DOCUMENTS

| | | |
|---|---|---|
| FR | 2367474 | 5/1978 |
| JP | 052601 | 2/2003 |

* cited by examiner

*Primary Examiner* — Joseph C Rodriguez
*Assistant Examiner* — Kalyanavenkateshware Kumar
(74) *Attorney, Agent, or Firm* — Levenfeld Pearlstein, LLC

(57) ABSTRACT

A magnetic sweeper configured to collect magnetic metal debris, such as nails, screws, sheet metal fragments, staples, rivets and the like from a surface, and to permit easy removal of the collected debris from the sweeper is disclosed. The sweeper comprises a non-metallic body, a permanent magnet disposed within the body, a non-metallic cover hingably mounted to the underside of the body and an integrated latch configured to removably secure the cover to the body. The sweeper is configured to removably engage a handle for controlling the sweeper, and in another embodiment, an extendable, telescoping extender may be connected between the coupler and the handle to permit the sweeper to be used in a wide variety of locations. Preferably, the sweeper body is configured to swivel upon application of torque to the handle. In use, the sweeper is passed over metallic debris using the handle to guide the body. As the body passes over such debris, the magnet attracts the debris and holds it against the outer surface of the cover. When debris collection is complete, the cover is unlatched from the body, and swung outwardly from the body, thereby displacing the collected debris to a location outside of the magnetic field of the magnet and permitting the debris to fall away from the cover.

20 Claims, 6 Drawing Sheets

MAGNETIC SWEEPER

BACKGROUND OF THE INVENTION

The present invention relates to a cleaning device. More particularly, the present invention concerns a magnetic sweeper configured to collect magnetic metal debris, such as nails, screws, sheet metal fragments, staples, rivets and the like from a surface, and to permit easy removal of the collected debris from the sweeper.

Small magnetic metal objects, such as nails, screws, sheet metal fragments, staples, rivets and the like, often drop to the floor or ground during use and create debris. If left on the floor or on the ground, such objects, which oftentimes are sharp, may pose a hazard to both people and machinery. Thus, it is desirable to remove such debris.

Since such debris often is comprised of magnetic materials, the prior art has developed various types of magnetic sweeper devices designed to attract and collect the debris. For example, in its most basic form, such a magnetic sweeper, includes a suction disk, a magnet adhered to a bottom side of the suction disk and a handle extending upwardly from a top side of the suction disk.

In use, the magnetic sweeper is moved along a surface by means of the handle, and magnetic metal objects on the surface are by means of the magnetic force of the magnet. A major drawback associated with this type of magnetic sweeper is that the user has to remove them from the magnet one by one, which is time-consuming and potentially hazardous. In addition, due to the length of the handle, the magnetic sweeper cannot access places of small height, such as beneath a cabinet, tool chest or the chassis of an automobile.

Various improvements to the basic magnetic sweeper design have been made over the years, and numerous other magnetic sweepers have been disclosed by the art. For example, U.S. Pat. No. 4,407,038 discloses a magnetic sweeper that includes a main body having end walls on which wheels are pivotally mounted. While the magnetic sweeper disclosed in this patent permits relatively easy operation, it is inconvenient to remove the debris captured by magnets.

In another design, U.S. Pat. No. 5,285,904 teaches a magnetic sweeper having a removable catcher member disposed on a housing and about a magnet. Metallic objects are picked up by magnetic attraction and held against the catcher member. When the catcher member is removed, the objects fall away from the sweeper and into a receptacle. However, because the catcher member requires the user to grip the catcher member on both sides in order to remove it from the housing, the user's hand may be injured by sharp ends and edges of the metallic objects when removing the catcher member.

Other magnetic sweepers are disclosed in U.S. Pat. No. 5,395,148 (teaching a cylindrical cuff to push collected debris to a non-magnetic area of the sweeper where it is released); U.S. Pat. No. 5,413,225 (disclosing a collector plate with a steel latch plate to affix the collector plate to the sweeper); U.S. Pat. No. 5,868,258 (covering a plastic sweeper with a handle-operated debris release system); U.S. Pat. No. 5,979,957 (disclosing a plurality of wheel shaped magnets affixed to a rake); U.S. Pat. No. 6,113,169 (teaching a magnetic wheel with a wiping member for scraping debris from the wheel); U.S. Pat. No. 6,142,310 (showing a magnetic sweeper having a removable catcher member disposed on a housing and about a magnet); U.S. Pat. No. 6,158,792 (teaching a magnet-holding bracket configured to accept wheels and a handle); U.S. Pat. No. 6,402,212 (disclosing a rotating magnetic cylinder); and U.S. Pat. No. 6,669,024 (showing a flat magnetic pick-up surface with a projection extending downward therefrom to create a space between the magnetic surface and the ground). However, none of the disclosed magnetic sweepers are particularly easy to use, lightweight, portable and adaptable for clearing debris from a variety of different locations, including floors, work tables and beneath cabinets, tool chests, vehicles and the like.

Accordingly, there exists a need for a magnetic sweeper to collect magnetic metal debris, such as nails, screws, sheet metal fragments, staples, rivets and the like from a surface, and to permit easy removal of the collected debris from the sweeper. Desirably, such a magnetic sweeper is lightweight and portable. More desirably, such a sweeper is adaptable for clearing debris from a variety of different locations. Most desirably, such a sweeper is simple to use and permits easy removal of the collected debris from the sweeper.

BRIEF SUMMARY OF THE INVENTION

The present invention comprises a magnetic sweeper configured to collect magnetic metal debris, such as nails, screws, sheet metal fragments, staples, rivets and the like from a surface, and to permit easy removal of the collected debris from the sweeper.

In the preferred embodiment, the sweeper of the present invention comprises a non-metallic body, a permanent magnet disposed within the body, a non-metallic cover hingeably mounted to the underside of the body and an integrated latch configured to removably secure the cover to the body. The body further comprises a plurality of low profile wheels mounted at the rear of the body, while the cover further comprises a plurality of wheels extending downwardly beneath the cover towards the front of the body to create a space between the cover and the surface upon which the debris is located.

The body also includes sockets on its top side configured to receive a boss member and to permit the boss member to rotate within the sockets in a direction from the front to the back of the body. The boss member is rotabably fastened to a yolk formed at an end of a coupler, such that the coupler may rotate about the boss member in a direction from one side of the body to the other.

In the preferred embodiment, the coupler is configured to modularly and removably engage a handle. In one embodiment, if the magnetic sweeper of the present invention may be used on a work table or other surface in close proximity to the user, the handle is directly connected to the coupler. In another embodiment, an extendable, telescoping extender may be connected between the coupler and the handle. Such an embodiment permits the magnetic sweeper of the present invention to be used on a floor, or to reach beneath a cabinet, tool chest or vehicle. Additionally, the rotation of the boss member within the socket, along with the rotation of the coupler about the boss member, advantageously permits the body of the magnetic sweeper of the present invention to swivel when a rotating force is applied to the handle.

In use, the magnetic sweeper is passed over metallic debris using the handle to guide the body. As the body passes over such debris, the magnet attracts the debris and holds it against the outer surface of the cover. When debris collection is complete, the cover is unlatched from the body, and swung outwardly from the body, thereby displacing the collected debris to a location outside of the magnetic field of the magnet and permitting the debris to fall away from the cover.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
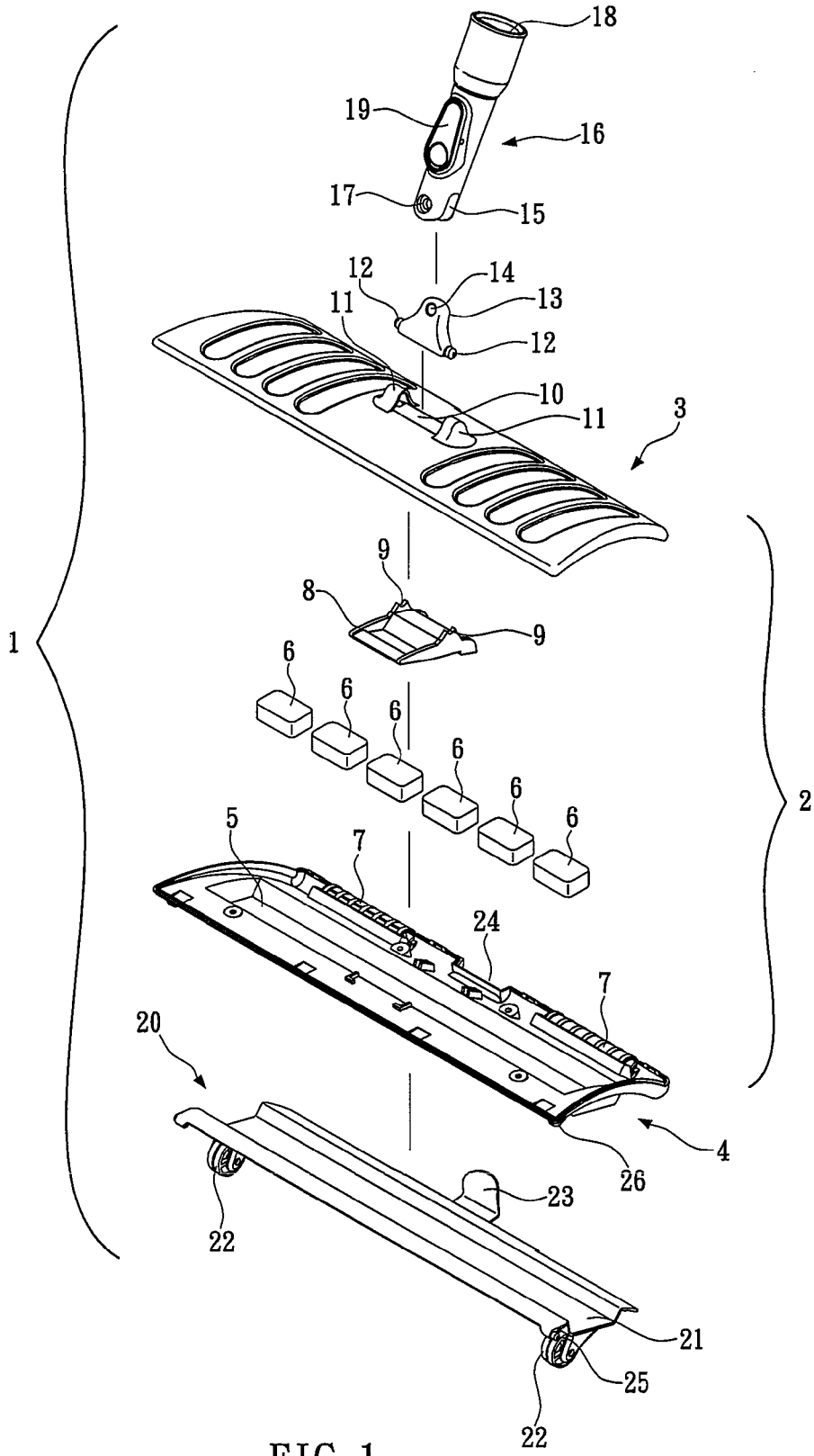
FIG. 1 is an exploded view of the magnetic sweeper of the present invention.

While the present invention is susceptible of embodiment in various forms, there are shown in the drawings and will hereinafter be described several preferred embodiments with the understanding that the present disclosure is to be considered an exemplification of the invention and is not intended to limit the invention to the specific embodiments illustrated.

It should be further understood that the title of this section of the specification, namely, "Detailed Description of the Invention," relates to a requirement of the United States Patent and Trademark Office, and does not imply, nor should be inferred to limit the subject matter disclosed herein.

As shown in FIG. 1, the magnetic sweeper 1 in the preferred embodiment of the present invention comprises a body 2. Body 2 is generally rectangular in shape with a slight arcuate profile. Body 2 is comprised of a top 3 and a bottom 4 which are sealingly engaged. Top 3 and bottom 4 preferably are comprised of a suitably strong, lightweight, rigid and non-metallic material, such as any number of plastics as are well known to those skilled in the art.

Integrated within bottom 4 is a bed 5 configured to receive a magnet 6. In the preferred embodiment, bed 5 is generally rectangular in shape and extends laterally across bottom 4, across substantially the entire width of bottom 4. Magnet 6 preferably comprises a permanent magnet sized for insertion into bed 5 and configured to exert an attractive magnetic force downwardly through bottom 4. In the preferred embodiment, magnet 6 comprises a plurality of individual magnets disposed within bed 5 and, preferably, evenly laterally spaced within bed 5. In another embodiment, magnet 6 comprises a single magnet, generally rectangular in shape, with a slight arcuate profile, matching the profile of body 2. Additionally, in the preferred embodiment, magnet 6 is sized to fill substantially all of bed 5 to provide a magnetic force across substantially the entire width of body 2. The composition and structure of magnetic 6 are well known to those skilled in the art. It will be appreciated, however, that other magnetic sources, such as an electromagnet, and numerous other shapes and configurations of magnets may be used for magnet 6 without departing from the scope of the present disclosure.

Bottom 4 further comprises in the preferred embodiment a plurality of low profile wheels 7. Wheels 7 are rotatably mounted to the rear edge of bottom 4 and are configured to permit sweeper 1 to easily travel over a wide variety of surfaces. Wheels 7 preferably are constructed of a suitably strong, lightweight, rigid and non-metallic material, such as any number of plastics as are well known to those skilled in the art. Further, wheels 7 are configured of a sufficiently small diameter such that the rear end of bottom 4 is suspended only slightly (less than ½" inch in the preferred embodiment) above the surface upon which sweeper 1 travels. In the preferred embodiment, wheels 7 comprise two elongated, barrel-style low profile wheels disposed equidistant from the side ends of bottom 4.

In the preferred embodiment, body 2 further comprises a boss mount member 8 disposed between magnet 6 and top 3. Boss mount member 8 is configured to form two semi-circular mounting seats 9 extending upwardly therefrom. Boss mount member 8 is configured to rest on the top surface of magnet 6 such that mounting seats 9 extend through an opening 10 formed in top 3 when top 3 is sealingly engaged with bottom 2. Like top 3 and bottom 4, boss mount member 8 preferably is constructed of a suitably strong, lightweight, rigid and non-metallic material, such as any number of plastics as are well known to those skilled in the art.

As discussed above, top 3 in the preferred embodiment includes opening 10 formed therein. Top 3 further comprises generally semi-circular hollow cavities 11 formed at either end of opening 10 and extending upwardly therefrom. Cavities 11 are configured to receive mounting seats 9 therein, thereby creating generally circular sockets at either end of opening 10 configured to engage mounting posts 12 of boss member 13.

Boss member 13 preferably is generally triangular in shape and includes mounting posts 12 extending outwardly from opposing bottom corners thereof. Mounting posts 12 are disposed within the sockets formed by cavities 11 and mounting seats 9 such that boss member may rotate within the sockets in a direction from the front of body 2 to the rear of body 2.

Boss member 13 is further configured in the preferred embodiment with a bore 14 extending through the width of boss member 13 and disposed at its top corner. The top corner of boss member 13 is configured to matingly engage a yolk 15 formed at the end of a coupler 16. Yolk 15 also includes a bore 17 extending through yolk 15. Boss member 13 and yolk 15 are rotatably fastened using a bolt (not shown) passing through bore 14 and bore 17, such that coupler 16 may rotate about boss member 13 in a direction from one side of body 2 to the other side of body 2. As with the previously described structural components of sweeper 1, boss member 13 preferably is constructed of a suitably strong, lightweight, rigid and non-metallic material, such as any number of plastics as are well known to those skilled in the art.

Coupler 16 includes yolk 15 disposed at its lower end and a receptacle 18 disposed at its upper end. Receptacle 18 is configured to matingly receive a handle or an extendable, telescoping extender connected between the coupler and the handle, depending upon the particular embodiment of the present invention. Coupler further comprises a push-button locking mechanism 19 for removably attaching the handle and/or extender. Such locking mechanisms are well known to those skilled in the art. Coupler 16 also preferably is constructed of a suitably strong, lightweight, rigid and non-metallic material, such as any number of plastics as are well known to those skilled in the art.

Sweeper 1 further comprises in the preferred embodiment a cover 20. Cover 20 is generally rectangular in shape and is configured to matingly engage the bottom surface of bottom 4, including an integrated channel 21 sized to accept bed 5 of bottom 4 which houses magnet 6. Cover 20 also comprises an integrated latch extending rearwardly therefrom and configured to lockingly engage a mating notch 24 formed in the rear edge of bottom 4.

Cover 20 also includes a plurality of wheels 22, two in the preferred embodiment, extending downwardly beneath cover 20 and mounted on either side of cover 20 towards the front end of cover 20. Wheels 22 are rotatably mounted to cover 20 and are configured to permit sweeper 1 to easily travel over a wide variety of surfaces. Further, wheels 22 are configured of a sufficiently large diameter such that the front end of bottom 4 is suspended above the surface upon which sweeper 1 travels at a distance greater than the rear end of bottom 4 (about 2" in the preferred embodiment). Such configuration allows the front end of sweeper 1 to pass over relatively large debris while providing sufficient clearance to permit a collection such debris to accumulate on the underside of sweeper 1 without interfering with the movement of sweeper 1. Wheels 22 preferably are constructed of a suitably strong, lightweight, rigid and non-metallic material, such as any number of plastics as are well known to those skilled in the art.

In the preferred embodiment, cover 20 is hingably mounted to the front end of bottom 4 such that the rear end of cover 20 may be swung downwardly and away from bottom 4. Preferably, such a hingeable mount comprises a pair of mounting posts 25 (only one such mounting post is shown in FIG. 1) integrated into either side of cover 20 configured to rotatably engage mating sockets 26 (only one such mating socket is shown in FIG. 1) formed in bottom 4. Cover 20 also preferably is constructed of the same suitably strong, lightweight, rigid and non-metallic material as the other structural components of sweeper 1, such as any number of plastics as are well known to those skilled in the art.

Figure 2:
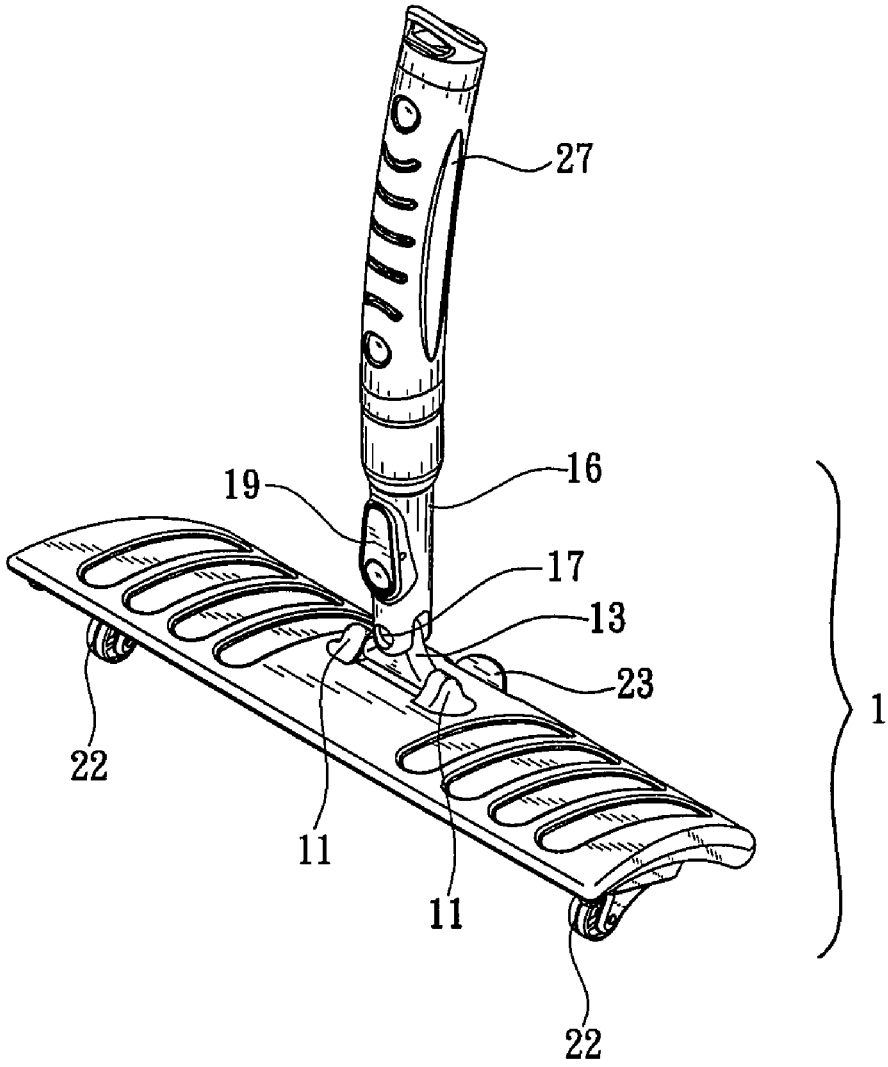
FIG. 2 is a perspective view of the magnetic sweeper of the present invention with a handle attached thereto.

As shown in FIG. 2, in the preferred embodiment, coupler 16 is configured to removably engage a handle 27. In this embodiment, the sweeper 1 is particularly useful for removing metallic debris from a work table or other surface in close proximity to the user. Handle 27 is removably attached to coupler 16 using push-button locking mechanism 19 to engage a mounting arm (not shown) extending outwardly from the bottom end of handle 27 and into coupler 16.

Figure 3:
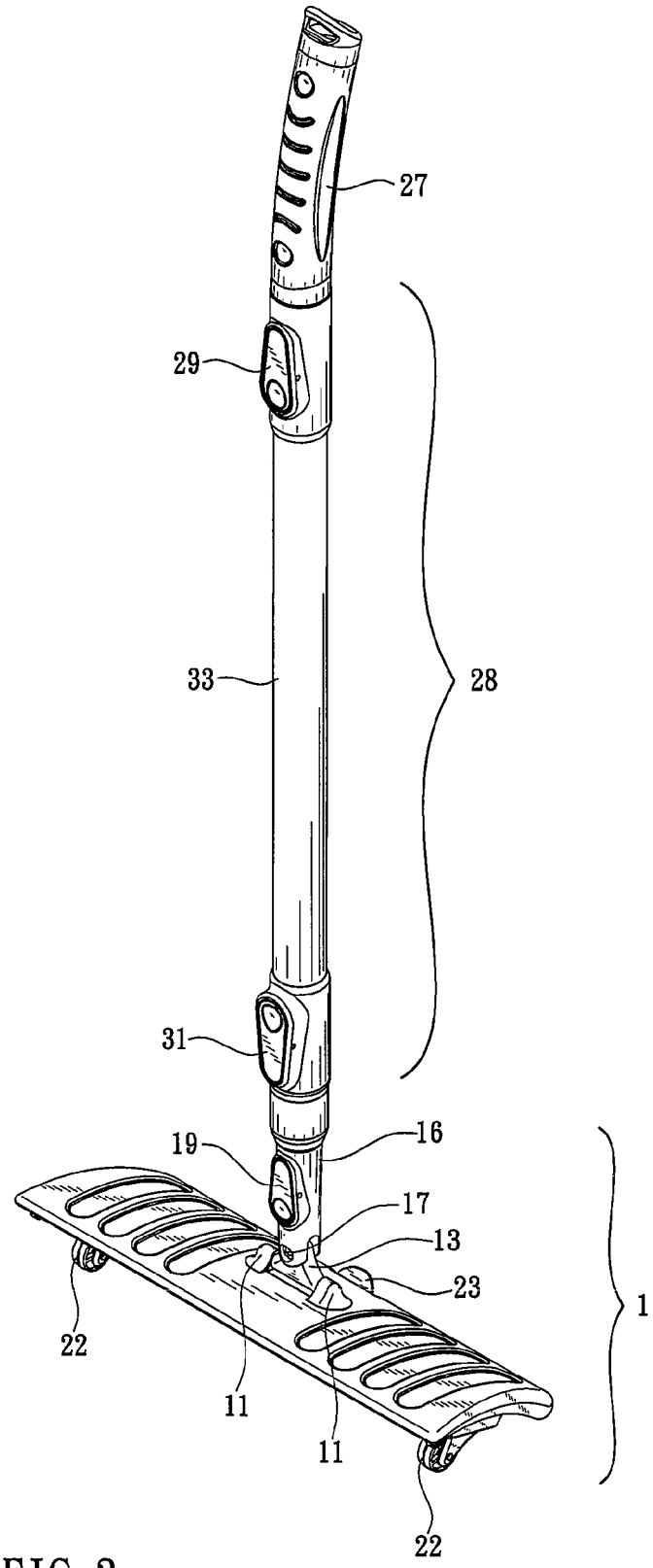
FIG. 3 is a perspective view of the magnetic sweeper of the present invention with an extendible, telescoping extender and a handle attached thereto.
Figure 4:
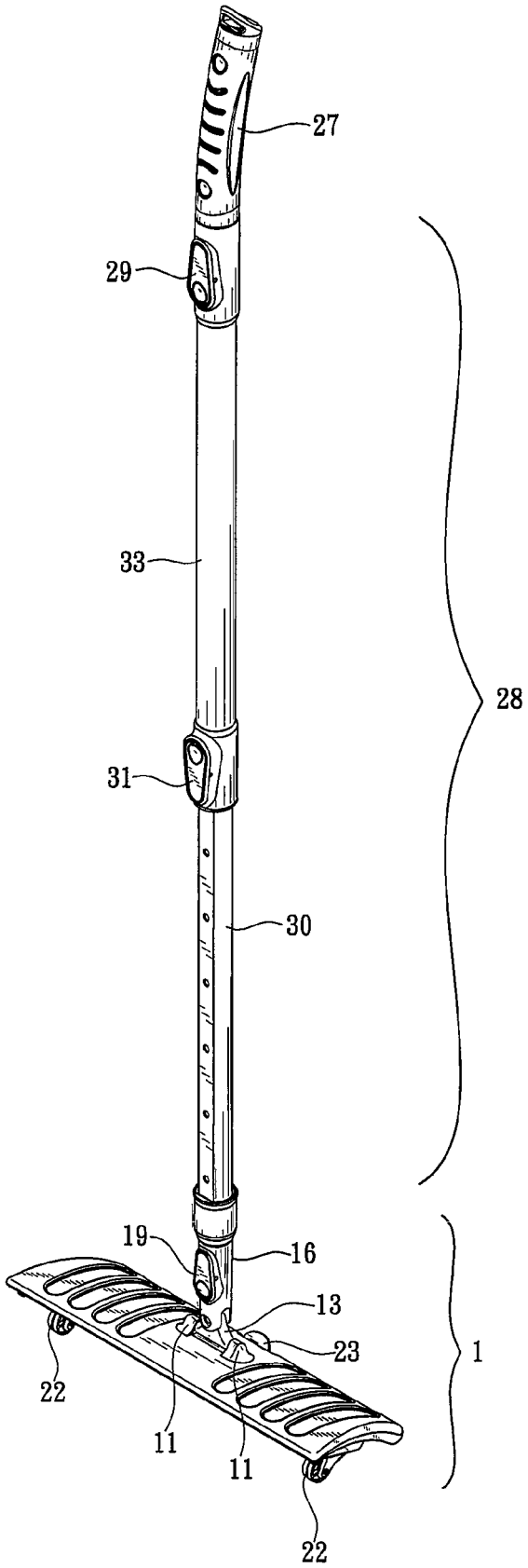
FIG. 4 is a perspective view of the magnetic sweeper of the present invention as shown in FIG. 3 with the extender fully extended.

In yet another embodiment of the magnetic sweeper of the present invention, as shown in FIGS. 3 and 4, an extendable, telescoping extender 28 may be connected between coupler 16 and handle 27. The general structure of extender 28 is known in the art and comprises a cylindrical tube 33 within which a telescoping arm 30 is slidably disposed from which arm 30 is extendible in a downward direction. Arm 30 further comprises a mounting arm (not shown) extending outwardly from the bottom end of extender 28 and into coupler 16 for removably attaching extender 28 to coupler 16. Extender 28 preferably further includes a push-button locking mechanism 31 for lockably extending arm 30 to a plurality of preset lengths. Extender 28 further comprises a second push-button locking mechanism 29 disposed at the top end of extender 28 and configured to engage a mounting arm (not shown) extending outwardly from the bottom end of handle 27 and into extender 28. Extender 28 preferably is constructed of a suitably strong, lightweight and rigid material, such as aluminum. Other suitable materials are well known to those skilled in the art.

The embodiment of the magnetic sweeper shown in FIGS. 3 and 4 permits the magnetic sweeper of the present invention to be used on a floor or lawn, in a garden, or to reach beneath a cabinet, tool chest or vehicle. The length of extender 28 may be adjusted by the user to accommodate any particular debris collection conditions.

Figure 5:
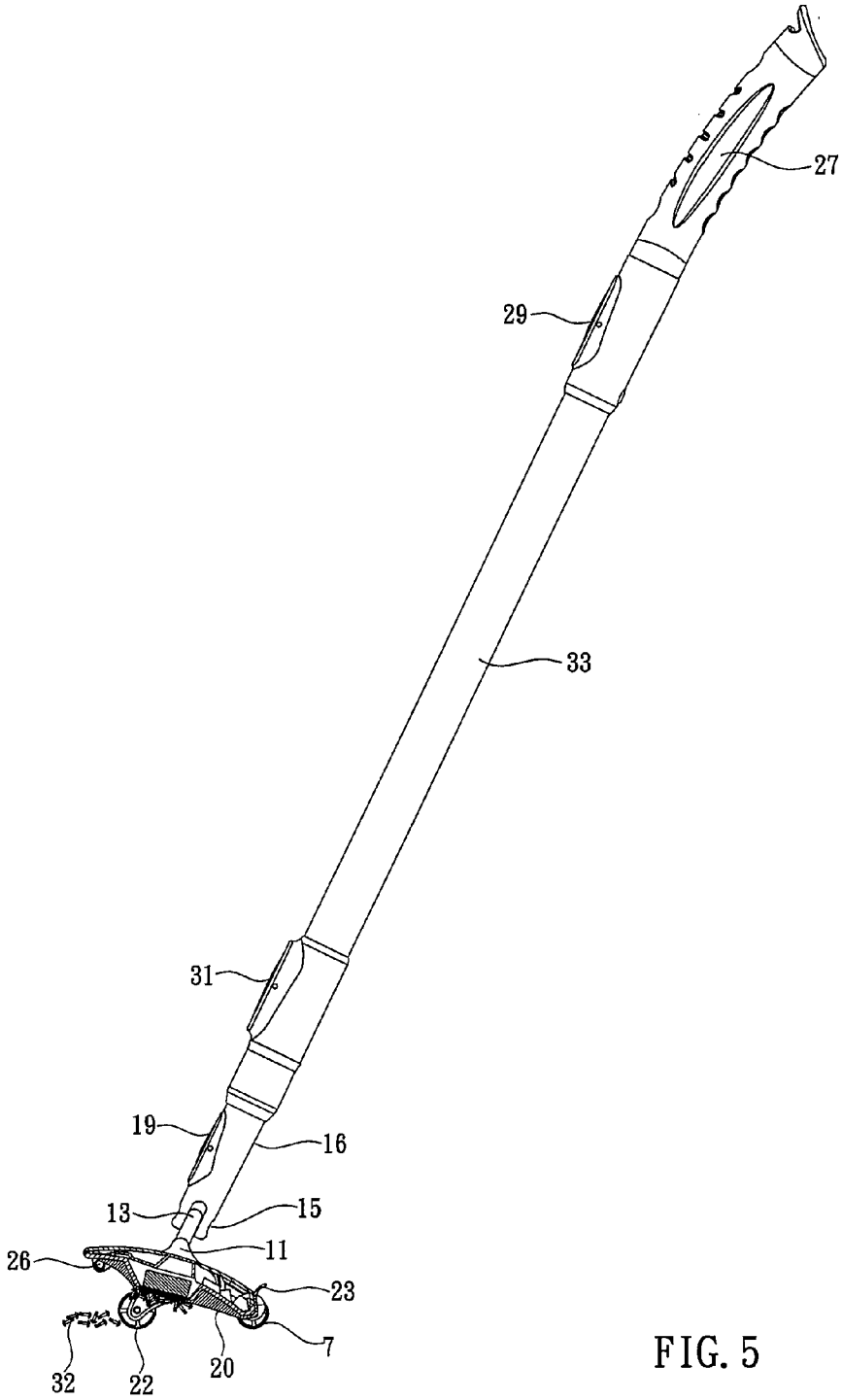
FIG. 5 is a side view of the magnetic sweeper of the present invention as shown in FIG. 3 collecting metallic debris with the cover in a closed position.

In use, as shown in FIG. 5, the magnetic sweeper 1 is passed over metallic debris 32 using handle 27 to guide the sweeper. As sweeper 1 passes over debris 32, magnet 6 attracts debris 32 and holds it against the outer surface of cover 20, where debris 32 collects. In one embodiment of the present invention (not shown) the outer surface of cover 20 includes a plurality of parallel, longitudinally aligned grooves to assist with the retention of collected debris 32 against cover 20.

As will be appreciated, the front-to-back rotation of the boss member 13 within the sockets formed by cavities 11 in top 3, along with the side-to-side rotation of coupler 16 about boss member 13, permit body 2 of sweeper 1 to swivel when a rotating force (torque) is applied to the handle 27 by the user. Such swiveling aids in the ease and efficiency of collection of debris 32.

Figure 6:
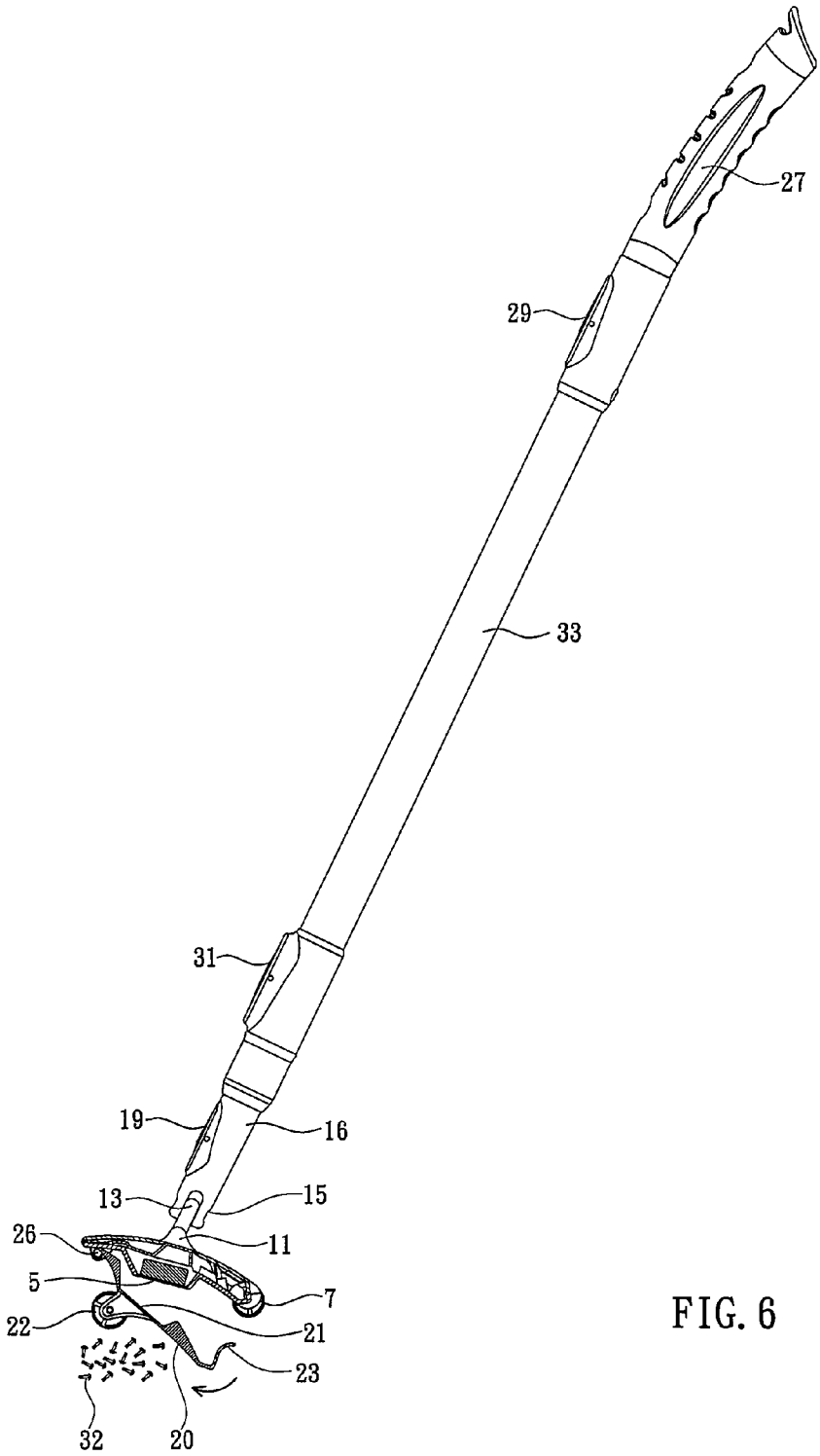
FIG. 6 is a side view of the magnetic sweeper of the present invention as shown in FIG. 3 releasing collected metallic debris with the cover in an open position.

When collection of debris 32 is complete, as shown in FIG. 6, cover 20 is unlatched from notch 24 in the rear edge of body 2 using latch 23. Cover 20 then is swung downwardly and away from bottom 4 of body 2, thereby displacing collected debris 32 to a location outside of the magnetic field of the magnet 6, and permitting debris 32 to fall away from cover 20. Debris 32 may then be collected for reuse or disposal.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

What is claimed is:

1. A magnetic sweeper comprising:

a body having a top and a bottom and having a cavity formed therein;

a magnet disposed within the cavity;

a plurality of body wheels having a first diameter rotatably mounted to the body and extending downwardly therefrom;

a cover hingeably mounted to the body and configured to cover substantially all of the bottom of the body, the cover having an inner surface and an outer surface, the cover having a plurality of cover wheels having a second diameter rotatably mounted thereto and extending downwardly therefrom;

a latch integrated into the cover and configured to removably attach the cover to the body, the latch further configured to engage a mating notch formed in the body;

a coupler mounted to the top of the body; and a handle mounted to the coupler;

wherein the cover is swingably movable from a location within the influence of the magnet to a location outside the influence of the magnet, and wherein the body wheels mounted to the body rotate about a body wheel axis and wherein the cover wheels mounted to the cover rotate about cover wheel axis that is parallel to and spaced from the body wheel axis, and wherein the second diameter of the cover wheels is greater than the first diameter of the body wheel and wherein the cover wheel axis and the body wheel axis are fixed relative to one another when the cover is closed on the body, such that a front end of the magnetic sweeper is at a greater height above a floor than a rear end of the sweeper.

2. The magnetic sweeper of claim 1 further comprising an extender is disposed between the coupler and the handle.

3. The magnetic sweeper of claim 2 wherein the extender is adjustable in length.

4. The magnetic sweeper of claim 1 wherein the handle is detachably mounted to the coupler.

5. The magnetic sweeper of claim 2 wherein the extender is detachably mounted to the coupler.

6. The magnetic sweeper of claim 2 wherein the handle is detachably mounted to the extender.

7. The magnetic sweeper of claim 1 wherein the coupler is mounted to the top of the body using a boss member, the boss member rotatably mounted to the top of the body and the coupler rotatably mounted to the boss member.

8. The magnetic sweeper of claim 1 wherein the body is configured to swivel upon application of a rotating force to the handle.

9. The magnetic sweeper of claim 2 wherein the body is configured to swivel upon application of a rotating force to the handle.

10. The magnetic sweeper of claim 1 wherein the cover further comprises a plurality of parallel longitudinally aligned grooves formed in the outer surface of the cover.

11. The magnetic sweeper of claim 1 wherein the body, the plurality of wheels, the cover, the latch, the coupler and the handle are formed of a non-magnetic material.

12. The magnetic sweeper of claim 11 wherein the non-magnetic material is plastic.

13. The magnetic sweeper of claim 2 wherein the extender is formed of aluminum.

14. The magnetic sweeper of claim 1 wherein the magnet is a permanent magnet.

15. The magnetic sweeper of claim 1 wherein the magnet is an electromagnet.

16. The magnetic sweeper of claim 4 wherein the handle is detachably mounted to the coupler using a push-button locking mechanism.

17. The magnetic sweeper of claim 5 wherein the extender is detachably mounted to the coupler using a push-button locking mechanism.

18. The magnetic sweeper of claim 6 wherein the handle is detachably mounted to the extender using a push-button locking mechanism.

19. The magnetic sweeper of claim 1 wherein the magnet comprises a plurality of individual magnets.

20. The magnetic sweeper of claim 1 wherein the cover is rigid.

* * * * *